US006587816B1

(12) United States Patent
Chazan et al.

(10) Patent No.: US 6,587,816 B1
(45) Date of Patent: Jul. 1, 2003

(54) FAST FREQUENCY-DOMAIN PITCH ESTIMATION

(75) Inventors: Dan Chazan, Haifa (IL); Meir Zibulski, Haifa (IL); Ron Hoory, Haifa (IL)

(73) Assignee: International Business Machines Corporation, Armonk, NY (US)

( * ) Notice: Subject to any disclaimer, the term of this patent is extended or adjusted under 35 U.S.C. 154(b) by 374 days.

(21) Appl. No.: 09/617,582

(22) Filed: Jul. 14, 2000

(51) Int. Cl.[7] ..... G10L 11/04
(52) U.S. Cl. ..... 704/207; 704/204
(58) Field of Search ..... 704/207, 203, 704/204

(56) References Cited

U.S. PATENT DOCUMENTS

| | | | | | |
|---|---|---|---|---|---|
| 4,885,790 | A | | 12/1989 | McAulay et al. | 704/265 |
| 4,937,868 | A | * | 6/1990 | Taguchi | 704/220 |
| 5,054,072 | A | | 10/1991 | McAulay et al. | 704/207 |
| 5,195,166 | A | | 3/1993 | Hardwick et al. | 704/200 |
| 5,226,108 | A | | 7/1993 | Hardwick et al. | 704/200 |
| 5,231,692 | A | | 7/1993 | Tanaka et al. | 704/200 |
| 5,452,398 | A | | 9/1995 | Yamada et al. | 704/223 |
| 5,519,166 | A | | 5/1996 | Furuhashi et al. | 84/603 |
| 5,696,873 | A | | 12/1997 | Bartkowiak | 704/216 |
| 5,751,900 | A | | 5/1998 | Serizawa | 704/207 |
| 5,774,836 | A | | 6/1998 | Bartkowiak | 704/207 |
| 5,774,837 | A | * | 6/1998 | Yeldener et al. | 704/208 |
| 5,781,880 | A | | 7/1998 | Su | 704/207 |
| 5,794,182 | A | | 8/1998 | Manduchi et al. | 704/219 |
| 5,797,119 | A | | 8/1998 | Ozawa | 704/223 |
| 5,799,271 | A | | 8/1998 | Byun et al. | 704/217 |
| 5,806,024 | A | | 9/1998 | Ozawa | 704/222 |
| 5,870,704 | A | | 2/1999 | Laroche | 704/209 |
| 5,884,253 | A | | 3/1999 | Kleijn | 704/223 |
| 6,272,460 | B1 | * | 8/2001 | Wu et al. | 704/226 |

OTHER PUBLICATIONS

Noll, A.M., "Pitch Determination of Human Speech by the Harmonic Product Spectrum, the Harmonic Sum Spectrum, and a Maximum Likelihood Estimate," Proc. Symp. Computer Proc. in Comm, 779–798, Apr. 1969.*

Schroeder, M.R., "Period Histogram and Product Spectrum: New Methods for Fundamental–Frequency Measurement," J. Acoust. Soc. Amer. 43(4), 829–834, Apr. 1968.*

Hess, "Pitch Determination of Speech Signals", (Springer–Verlag, 1983), contents, pp. 1, 396–439, 446–455.

Martin, "Comparison of Pitch Detection by Cepstrum and Spectral Comb Analysis", *Proceedings of the International Conference on Acoustics, Speech, and Signal Processing* (*ICASSP*), 1982, pp. 180–183.

Medan et al, "Super Resolution Pitch Determination of Speech Signals", *IEEE Transactions on Signal Processing* 39(1), 1991, pp. 41–48.

McAulay et al, "Speech Analysis/Synthesis Based on a Sinusoidal Representation", *IEEE Transactions on Acoustics, Speech, and Signal Processing ASSP* 34(4), 1986, pp. 744, 746, 748, 752, 754.

Laroche, J. and Dolson, M. Phase Vocoder: About This Phasiness Business. 1997 IEEE ASSP Workshop on Applications of Signal Processing to Audio and Acoutics, 1997, pp. 19–22 Oct. 1997.

* cited by examiner

*Primary Examiner*—Marsha D. Banks-Harold
*Assistant Examiner*—Donald L. Storm
(74) *Attorney, Agent, or Firm*—Darby & Darby

(57) ABSTRACT

A method for estimating a pitch frequency of an audio signal includes computing a first transform of the signal to a frequency domain over a first time interval, and computing a second transform of the signal to the frequency domain over a second time interval, which contains the first time interval. A line spectrum of the signal is found, based on the first and second transforms, the spectrum including spectral lines having respective line amplitudes and line frequencies. A utility function that is periodic in the frequencies of the lines in the spectrum is then computed. This function is indicative, for each candidate pitch frequency in a given pitch frequency range, of a compatibility of the spectrum with the candidate pitch frequency. The pitch frequency of the speech signal is estimated responsive to the utility function.

52 Claims, 10 Drawing Sheets

32

FROM STEP 30
40
DUAL-WINDOW FREQUENCY TRANSFORM
42
ESTIMATE LINE SPECTRUM FOR SHORT WINDOW
44
ESTIMATE LINE SPECTRUM FOR LONG WINDOW
46
FIND HIGH-FREQUENCY PITCH CANDIDATES
48
FIND LOW-FREQUENCY PITCH CANDIDATES
TO STEP 34

FAST FREQUENCY-DOMAIN PITCH ESTIMATION

FIELD OF THE INVENTION

The present invention relates generally to methods and apparatus for processing of audio signals, and specifically to methods for estimating the pitch of a speech signal.

BACKGROUND OF THE INVENTION

Speech sounds are produced by modulating air flow in the speech tract. Voiceless sounds originate from turbulent noise created at a constriction somewhere in the vocal tract, while voiced sounds are excited in the larynx by periodic vibrations of the vocal cords. Roughly speaking, the variable period of the laryngeal vibrations gives rise to the pitch of the speech sounds. Low-bit-rate speech coding schemes typically separate the modulation from the speech source (voiced or unvoiced), and code these two elements separately. In order to enable the speech to be properly reconstructed, it is necessary to accurately estimate the pitch of the voiced parts of the speech at the time of coding. A variety of techniques have been developed for this purpose, including both time- and frequency-domain methods. A number of these techniques are surveyed by Hess in Pitch Determination of Speech Signals (Springer-Verlag, 1983), which is incorporated herein by reference.

The Fourier transform of a periodic signal, such as voiced speech, has the form of a train of impulses, or peaks, in the frequency domain. This impulse train corresponds to the line spectrum of the signal, which can be represented as a sequence $\{(a_i, \theta_i)\}$, wherein $\theta_i$ are the frequencies of the peaks, and $a_i$ are the respective complex-valued line spectral amplitudes. To determine whether a given segment of a speech signal is voiced or unvoiced, and to calculate the pitch if the segment is voiced, the time-domain signal is first multiplied by a finite smooth window. The Fourier transform of the windowed signal is then given by:

$$X(\theta) = \sum_k a_k W(\theta - \theta_k) \tag{1}$$

wherein $W(\theta)$ is the Fourier transform of the window.

Given any pitch frequency, the line spectrum corresponding to that pitch frequency could contain line spectral components at all multiples of that frequency. It therefore follows that any frequency appearing in the line spectrum may be a multiple of a number of different candidate pitch frequencies. Consequently, for any peak appearing in the transformed signal, there will be a sequence of candidate pitch frequencies that could give rise to that particular peak, wherein each of the candidate frequencies is an integer dividend of the frequency of the peak. This ambiguity is present whether the spectrum is analyzed in the frequency domain, or whether it is transformed back to the time domain for further analysis.

Frequency-domain pitch estimation is typically based on analyzing the locations and amplitudes of the peaks in the transformed signal $X(\theta)$. For example, a method based on correlating the spectrum with the "teeth" of a prototypical spectral comb is described by Martin in an article entitled "Comparison of Pitch Detection by Cepstrum and Spectral Comb Analysis," in Proceedings of the International Conference on Acoustics, Speech and Signal Processing (ICASSP), pages 180–183 (1982), which is incorporated herein by reference. The pitch frequency is given by the comb frequency that maximizes the correlation of the comb function with the transformed speech signal.

A related class of schemes for pitch estimation are "cepstral" schemes, as described, for example, on pages 396–408 of the above-mentioned book by Hess. In this technique, a log operation is applied to the frequency spectrum of the speech signal, and the log spectrum is then transformed back to the time domain to generate the cepstral signal. The pitch frequency is the location of the first peak of the time-domain cepstral signal. This corresponds precisely to maximizing over the period T, the correlation of the log of the amplitudes corresponding to the line frequencies z(i) with $\cos(\omega(i)T)$. For each guess of the pitch period T, the function $\cos(\omega T)$ is a periodic function of $\omega$. It has peaks at frequencies corresponding to multiples of the pitch frequency 1/T. If those peaks happen to coincide with the line frequencies, then 1/T is a good candidate to be the pitch frequency, or some multiple thereof.

In another vein, a common method for time-domain pitch estimation use correlation-type schemes, which search for a pitch period T that maximizes the cross-correlation of a signal segment centered at time t and one centered at time t-T. The pitch frequency is the inverse of T. A method of this sort is described, for example, by Medan et al., in "Super Resolution Pitch Determination of Speech Signals," published in IEEE Transactions on Signal Processing 39(1), pages 41–48 (1991), which is incorporated herein by reference.

Both time- and frequency-domain methods of pitch determination are subject to instability and error, and accurate pitch determination is therefore computationally intensive. In time domain analysis, for example, a high-frequency component in the line spectrum results in the addition of an oscillatory term in the cross-correlation. This term varies rapidly with the estimated pitch period T when the frequency of the component is high. In such a case, even a slight deviation of T from the true pitch period will reduce the value of the cross-correlation substantially and may lead to rejection of a correct estimate. A high-frequency component will also add a large number of peaks to the cross-correlation, which complicate the search for the true maximum. In the frequency domain, a small error in the estimation of a candidate pitch frequency will result in a major deviation in the estimated value of any spectral component that is a large integer multiple of the candidate frequency.

An exhaustive search, with high resolution, must therefore be made over all possible candidates and their multiples in order to avoid missing the best candidate pitch for a given input spectrum. It is often necessary (dependent on the actual pitch frequency) to search the sampled spectrum up to high frequencies, above 1500 Hz. At the same time, the analysis interval, or window, must be long enough in time to capture at least several cycles of every conceivable pitch candidate in the spectrum, resulting in an additional increase in complexity. Analogously, in the time domain, the optimal pitch period T must be searched for over a wide range of times and with high resolution. The search in either case consumes substantial computing resources. The search criteria cannot be relaxed even during intervals that may be unvoiced, since an interval can be judged unvoiced only after all candidate pitch frequencies or periods have been ruled out. Although pitch values from previous frames are commonly used in guiding the search for the current value, the search cannot be limited to the neighborhood of the previous pitch. Otherwise, errors in one interval will be perpetuated in subsequent intervals, and voiced segments may be confused for unvoiced.

Various solutions have been proposed for improving the accuracy and efficiency of pitch determination. For example, McAulay et al. describe a method for tracking the line frequencies of speech signals and for reproducing the signal from these frequencies in U.S. Pat. No. 4,885,790 and in an article entitled "Speech Analysis/Synthesis Based on a Sinusoidal Representation," in IEEE Transactions on Acoustics, Speech and Signal Processing ASSP-34(4), pages 744–754 (1986). These documents are incorporated herein by reference. The authors use a sinusoidal model for the speech waveform to analyze and synthesize speech based on the amplitudes, frequencies and phases of the component sine waves in the speech signal. Any number of methods may be used to obtain the pitch values from the line frequencies. In U.S. Pat. No. 5,054,072, whose disclosure is also incorporated herein by reference, McAulay et al. describe refinements of their method. In one of these refinements, a pitch-adaptive channel encoding technique varies the channel spacing in accordance with the pitch of the speaker's voice.

An improved method of pitch estimation is described by Hardwick et al., in U.S. Pat. Nos. 5,195,166 and 5,226,108, whose disclosures are incorporated herein by reference. An error measure between hypothesized successive time segments separated by a pitch interval is used to evaluate the quality of the pitch for integer pitch values. The criterion is refined to include neighboring signal frames to enforce pitch continuity. Pitch regions are used to reduce the amount of computation required in making the initial pitch estimate. A refinement technique is used to obtain the pitch, found earlier as an integer value, at a higher resolution of up to 1/8 of a sample point.

U.S. Pat. No. 5,870,704, to Laroche, whose disclosure is incorporated herein by reference, describes a method for estimating the time-varying spectral envelope of a time-varying signal. Local maxima of a spectrum of the signal are identified. A masking curve is applied in order to mask out spurious maxima. The masking curve has a peak at a particular maximum, and descends away therefrom. Local maxima falling below the curve are eliminated. The masking curve is subsequently adjusted according to some measure of the presence of spurious maxima. The result is supposed to be a spectrum in which only relevant maxima are present.

U.S. Pat. Nos. 5,696,873 and 5,774,836, to Bartkowiak, whose disclosures are incorporated herein by reference, are concerned with improving cross-correlation schemes for pitch value determination. It describe two methods for dealing with cases in which the First Formant, which is the lowest resonance frequency of the vocal tract, produces high energy at some integer multiple of the pitch frequency. The problem arises to a large degree because the cross-correlation interval is chosen to be equal (or close) to the pitch interval. Hypothesizing a short pitch interval may result in that hypothesis being confirmed in the form of a spurious peak of the correlation value at that point. One of the methods proposed by Bartkowiak involves increasing the window size at the beginning of a voiced segment. The other method draws conclusions from the presence or lack of all multiples of a hypothesized pitch value in the list of correlation maxima.

Other methods for improving the accuracy and efficiency of pitch estimation are described, for example, in U.S. Pat. No. 5,781,880, to Su; U.S. Pat. No. 5,806,024, to Ozawa; U.S. Pat. No. 5,794,182, to Manduchi et al.; U.S. Pat. No. 5,751,900, to Serizawa; U.S. Pat. No. 5,452,398, to Yamada et al.; U.S. Pat. No. 5,799,271, to Byun et al.; U.S. Pat. No. 5,231,692, to Tanaka et al.; and U.S. Pat. No. 5,884,253, to Kleijn. The disclosures of these patents are incorporated herein by reference.

SUMMARY OF THE INVENTION

It is an object of the present invention to provide improved methods and apparatus for determining the pitch of an audio signal, and particularly of a speech signal.

It is a further object of some aspects of the present invention to provide an efficient method for exhaustive pitch determination with high resolution. Because any pitch quality measure may have very narrow peaks as a function of the pitch frequency value, evaluating the measure with insufficient resolution may result in misestimating the location of a peak by a small amount. In this case, the pitch quality measure will be sampled slightly away from the peak, resulting in a low estimated value for the peak, when a precise evaluation would have yielded a high value for that peak. As a result, the true pitch may be discarded altogether from the list of pitch candidates. Prior art schemes which start off with a search for a pitch integer value and then refine the resulting list of pitch values all suffer from this very serious flaw. Thus, only exhaustive, high-resolution pitch frequency evaluation, as provided by preferred embodiments of the present invention, guarantees that the true pitch will be included in the list of tested pitch values.

In preferred embodiments of the present invention, a speech analysis system determines the pitch of a speech signal by analyzing the line spectrum of the signal over multiple time intervals simultaneously. A short-interval spectrum, useful particularly for finding high-frequency spectral components, is calculated from a windowed Fourier transform of the current frame of the signal. One or more longer-interval spectra, useful for lower-frequency components, are found by combining the windowed Fourier transform of the current frame with those of one or more previous frames. In this manner, pitch estimates over a wide range of frequencies are derived using optimized analysis intervals with minimal added computational burden on the system. The best pitch candidate is selected from among the various frequency ranges. The system is thus able to satisfy the conflicting objectives of high resolution and high computational efficiency.

In some preferred embodiments of the present invention, a utility function is computed in order to measure efficiently the extent to which any particular candidate pitch frequency is compatible with the line spectrum under analysis. The utility function is built up as a superposition of influence functions calculated for each significant line in the spectrum. The influence functions are preferably periodic in the ratio of the respective line frequency to the candidate pitch frequency, with maxima around pitch frequencies that are integer dividends of the line frequency and minima, most preferably zeroes, in between. Preferably, the influence functions are piecewise linear, so that they can be represented simply and efficiently by their break point values, with the values between the break points determined by interpolation. Thus, in place of the cosine function used in cepstral pitch estimation methods, these embodiments of the present invention provide another, much simpler periodic function and use the special structure of that function to enhance the efficiency of finding the pitch. The log of the amplitudes used in cepstral methods is replaced in embodiments of the present invention by the amplitudes themselves, although substantially any function of the amplitudes may be used with the same gains in efficiency.

The influence functions are applied to the lines in the spectrum in succession, preferably in descending order of amplitude, in order to quickly find the full range of candidate pitch frequencies that are compatible with the lines. After each iteration, incompatible pitch frequency intervals are pruned out, so that the succeeding iterations are performed on ever smaller ranges of candidate pitch frequencies. In this way, the compatible candidate frequency intervals can be evaluated exhaustively without undue computational burden. The pruning is particularly important in the high-frequency range of the spectrum, in which high-resolution computation is required for accurate pitch determination.

The utility function, operating on the line spectrum, is thus used to determine a utility value for each candidate pitch frequency in the search range based on the line spectrum of the current frame of the audio signal. The utility value for each candidate is indicative of the likelihood that it is the correct pitch. The estimated pitch frequency for the frame is therefore chosen from among the maxima of the utility function, with preference given generally to the strongest maximum. In choosing the estimated pitch, the maxima are preferably weighted by frequency, as well, with preference given to higher pitch frequencies. The utility value of the final pitch estimate is preferably used, as well, in deciding whether the current frame is voiced or unvoiced.

The present invention is particularly useful in low-bit-rate encoding and reconstruction of digitized speech, wherein the pitch and voiced/unvoiced decision for the current frame are encoded and transmitted along with features of the modulation of the frame. Preferred methods for such coding and reconstruction are described in U.S. patent application Ser. Nos.09/410,085 and 09/432,081, which are assigned to the assignee of the present patent application, and whose disclosures are incorporated herein by reference. Alternatively, the methods and systems described herein may be used in conjunction with other methods of speech encoding and reconstruction, as well as for pitch determination in other types of audio processing systems.

There is therefore provided, in accordance with a preferred embodiment of the present invention, a method for estimating a pitch frequency of an audio signal, including:

computing a first transform of the signal to a frequency domain over a first time interval;

computing a second transform of the signal to the frequency domain over a second time interval, which contains the first time interval; and estimating the pitch frequency of the speech signal responsive to the first and second transforms.

Preferably, the first and second transforms include Short Time Fourier Transforms. Further preferably, the first time interval includes a current frame of the speech signal, and the second time interval includes the current frame and a preceding frame, and computing the second transform includes combining the first transform with a transform computed over the preceding frame. Most preferably, the transforms generate respective spectral coefficients, and combining the first transform with the transform computed over the preceding frame includes applying a phase shift, proportional to the frequency and to a duration of the frame, to the coefficients generated by the transform computed over the preceding frame and adding the phase-shifted coefficients to the coefficients generated by the first transform.

Additionally or alternatively, estimating the pitch frequency includes deriving first and second line spectra of the signal from the first and second transforms, respectively, and determining the pitch frequency based on the line spectra. Preferably, determining the pitch frequency includes deriving first and second candidate pitch frequencies from the first and second line spectra, respectively, and choosing one of the first and second candidates as the pitch frequency. Most preferably, deriving the first and second candidates includes defining high and low ranges of possible pitch frequencies, and finding the first candidate in the high range and the second candidate in the low range.

Preferably, the audio signal includes a speech signal, and including encoding the speech signal responsive to the estimated pitch frequency.

There is also provided, in accordance with a preferred embodiment of the present invention, a method for estimating a pitch frequency of a speech signal, including:

finding a line spectrum of the signal, the spectrum including spectral lines having respective line amplitudes and line frequencies;

computing a utility function that is periodic in the frequencies of the lines in the spectrum, which function is indicative, for each candidate pitch frequency in a given pitch frequency range, of a compatibility of the spectrum with the candidate pitch frequency; and estimating the pitch frequency of the speech signal responsive to the utility function.

Preferably, computing the utility function includes computing at least one influence function that is periodic in a ratio of the frequency of one of the spectral lines to the candidate pitch frequency. Further preferably, computing the at least one influence function includes computing a function of the ratio having maxima at integer values of the ratio and minima therebetween. Most preferably, computing the function of the ratio includes computing values of a piecewise linear function c(f), having a maximum value in a first interval surrounding f=0, a minimum value in a second interval surrounding f=1/2, and a value that varies linearly in a transition interval between the first and second intervals.

Alternatively or additionally, computing the at least one influence function includes computing respective influence functions for multiple lines in the spectrum, and computing the utility function includes computing a superposition of the influence functions. Preferably, the respective influence functions include piecewise linear functions having break points, and computing the superposition includes calculating values of the influence functions at the break points, such that the utility function is determined by interpolation between the break points. Most preferably, computing the respective influence functions includes computing at least first and second influence functions for first and second lines in the spectrum in succession, and computing the utility function includes computing a partial utility function including the first influence function and then adding the second influence function to the partial utility function by calculating the values of the second influence function at the break points of the partial utility function and calculating the values of the partial utility function at the break points of the second influence function.

In a preferred embodiment, computing the respective influence functions includes performing the following steps iteratively over the lines in the spectrum:

computing a first influence function for a first line in the spectrum;

responsive to the first influence function, identifying one or more intervals in the pitch frequency range that are incompatible with the spectrum;

defining a reduced pitch frequency range from which the one or more intervals have been eliminated; and computing a second influence function for a second line in the spectrum, while substantially restricting computation of the second influence to pitch frequencies within the reduced range.

Preferably, computing the superposition includes calculating a partial utility function including the first influence function but not including the second influence function, and identifying the one or more intervals includes eliminating the intervals in which the partial utility function is below a specified level. Most preferably, the specified level is determined responsive to the line amplitudes of the lines in the spectrum that are not included in the partial utility function. Additionally or alternatively, performing the steps iteratively includes iterating over the lines in the spectrum in order of decreasing amplitude.

Preferably, estimating the pitch frequency includes choosing a candidate pitch frequency at which the utility function has a local maximum. Typically, the chosen pitch frequency is one of a plurality of frequencies at which the utility function has local maxima, and choosing the candidate pitch frequency includes preferentially selecting one of the maxima because it has a higher frequency than another one of the maxima. Additionally or alternatively, choosing the candidate pitch frequency includes preferentially selecting one of the maxima because it is near in frequency to a previously-estimated pitch frequency of a preceding frame of the speech signal.

In a preferred embodiment, the method includes determining whether the speech signal is voiced or unvoiced by comparing a value of the local maximum to a predetermined threshold.

There is additionally provided, in accordance with a preferred embodiment of the present invention, apparatus for estimating a pitch frequency of an audio signal, including an audio processor, which is adapted to compute a first transform of the signal to a frequency domain over a first time interval and a second transform of the signal to a frequency domain over a second time interval, which contains the first time interval, and to estimate the pitch frequency of the speech signal responsive to the first and second frequency transforms.

There is further provided, in accordance with a preferred embodiment of the present invention, apparatus for estimating a pitch frequency of an audio signal, including an audio processor, which is adapted to find a line spectrum of the signal, the spectrum including spectral lines having respective line amplitudes and line frequencies, to compute a utility function that is periodic in the frequencies of the lines in the spectrum, which function is indicative, for each candidate pitch frequency in a given pitch frequency range, of a compatibility of the spectrum with the candidate pitch frequency, and to estimate the pitch frequency of the speech signal responsive to the periodic function.

There is moreover provided, in accordance with a preferred embodiment of the present invention, a computer software product, including a computer-readable storage medium in which program instructions are stored, which instructions, when read by a computer receiving an audio signal, cause the computer to compute a first transform of the signal to a frequency domain over a first time interval and a second transform of the signal over a second time interval to the frequency domain, which contains the first time interval, and to estimate the pitch frequency of the speech signal responsive to the first and second transforms.

There is furthermore provided, in accordance with a preferred embodiment of the present invention, a computer software product, including a computer-readable storage medium in which program instructions are stored, which instructions, when read by a computer receiving an audio signal, cause the computer to find a line spectrum of the signal, the spectrum including spectral lines having respective line amplitudes and line frequencies, to compute a utility function that is periodic in the frequencies of the lines in the spectrum, which function is indicative, for each candidate pitch frequency in a given pitch frequency range, of a compatibility of the spectrum with the candidate pitch frequency, and to estimate the pitch frequency of the speech signal responsive to the periodic function.

The present invention will be more fully understood from the following detailed description of the preferred embodiments thereof, taken together with the drawings in which:

DETAILED DESCRIPTION OF PREFERRED EMBODIMENTS

Figure 1:
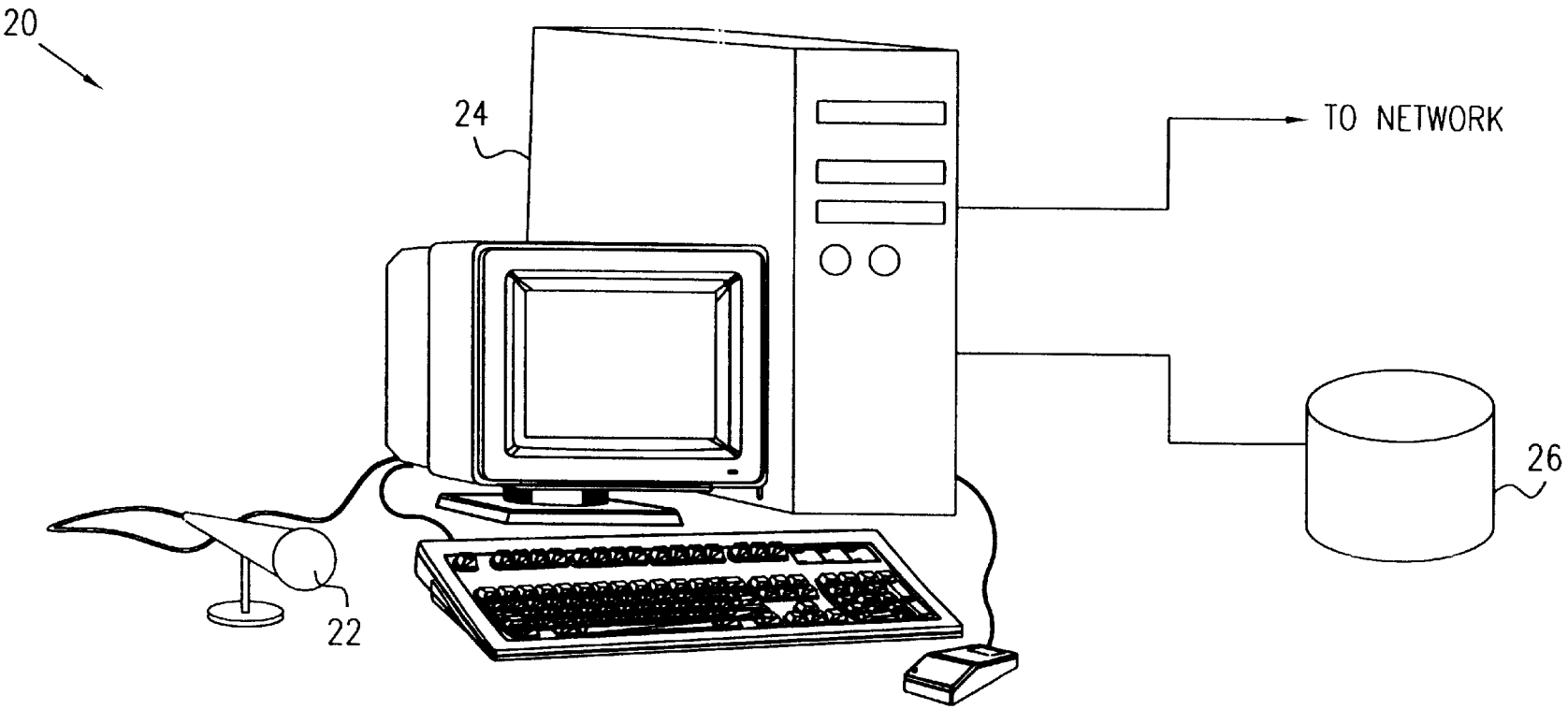
FIG. 1 is a schematic, pictorial illustration of a system for speech analysis and encoding, in accordance with a preferred embodiment of the present invention.

FIG. 1 is a schematic, pictorial illustration of a system 20 for analysis and encoding of speech signals, in accordance with a preferred embodiment of the present invention. The system comprises an audio input device 22, such as a microphone, which is coupled to an audio processor 24. Alternatively, the audio input to the processor may be provided over a communication line or recalled from a storage device, in either analog or digital form. Processor 24 preferably comprises a general-purpose computer programmed with suitable software for carrying out the functions described hereinbelow. The software may be provided to the processor in electronic form, for example, over a network, or it may be furnished on tangible media, such as CD-ROM or non-volatile memory. Alternatively or additionally, processor 24 may comprise a digital signal processor (DSP) or hard-wired logic.

Figure 2:
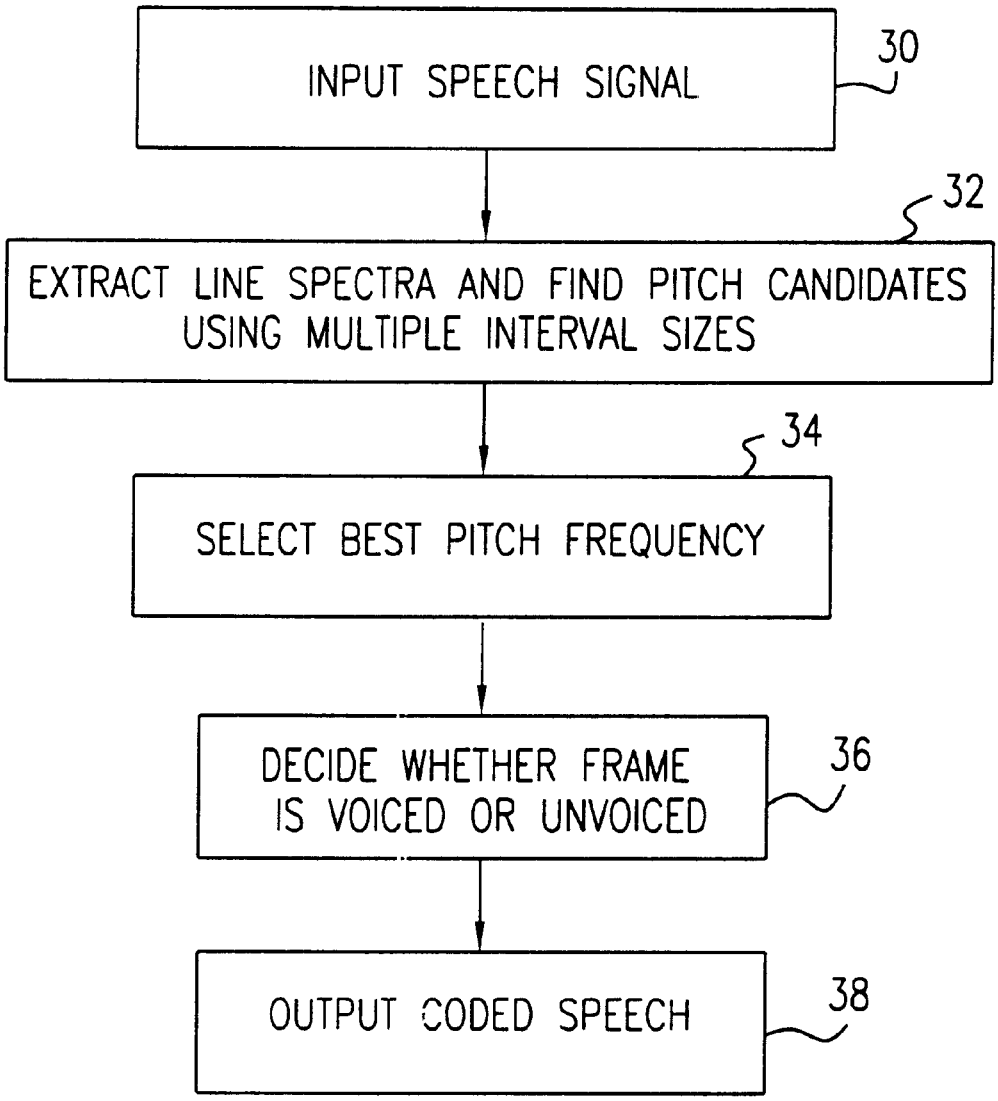
FIG. 2 is a flow chart that schematically illustrates a method for pitch determination and speech encoding, in accordance with a preferred embodiment of the present invention.

FIG. 2 is a flow chart that schematically illustrates a method for processing speech signals using system 20, in accordance with a preferred embodiment of the present invention. At an input step 30, a speech signal is input from device 22 or from another source and is digitized for further processing (if the signal is not already in digital form). The digitized signal is divided into frames of appropriate duration, typically 10 ms, for subsequent processing. At a pitch identification step 32, processor 24 extracts an approximate line spectrum of the signal for each frame. The spectrum is extracted by analyzing the signal over multiple time intervals simultaneously, as described hereinbelow. Preferably, two intervals are used for each frame: a short interval for extraction of high-frequency pitch values, and a long-interval for extraction of low-frequency values. Alternatively, a greater number of intervals may be used. The low- and high-frequency portions together cover the entire range of possible pitch values. Based on the extracted spectra, candidate pitch frequencies for the current frame are identified.

The best estimate of the pitch frequency for the current frame is selected from among the candidate frequencies in all portions of the spectrum, at a pitch selection step 34. Based on the selected pitch, system 24 determines whether the current frame is actually voiced or unvoiced, at a voicing decision step 36. At an output coding step 38, the voiced/unvoiced decision and the selected pitch frequency are used in encoding the current frame. Most preferably, the methods described in the above-mentioned U.S. patent application Ser. Nos. 09/410,085 and 09/432,081 are used at this step, although substantially any other method of encoding known in the art may also be used. Preferably, the coded output includes features of the modulation of the stream of sounds along with the voicing and pitch information. The coded output is typically transmitted over a communication link and/or stored in a memory 26 (FIG. 1). In any case, the methods used for extracting the modulation information and encoding the speech signals are beyond the scope of the present invention. The methods for pitch determination described herein may also be used in other audio processing applications, with or without subsequent encoding.

Figure 3:
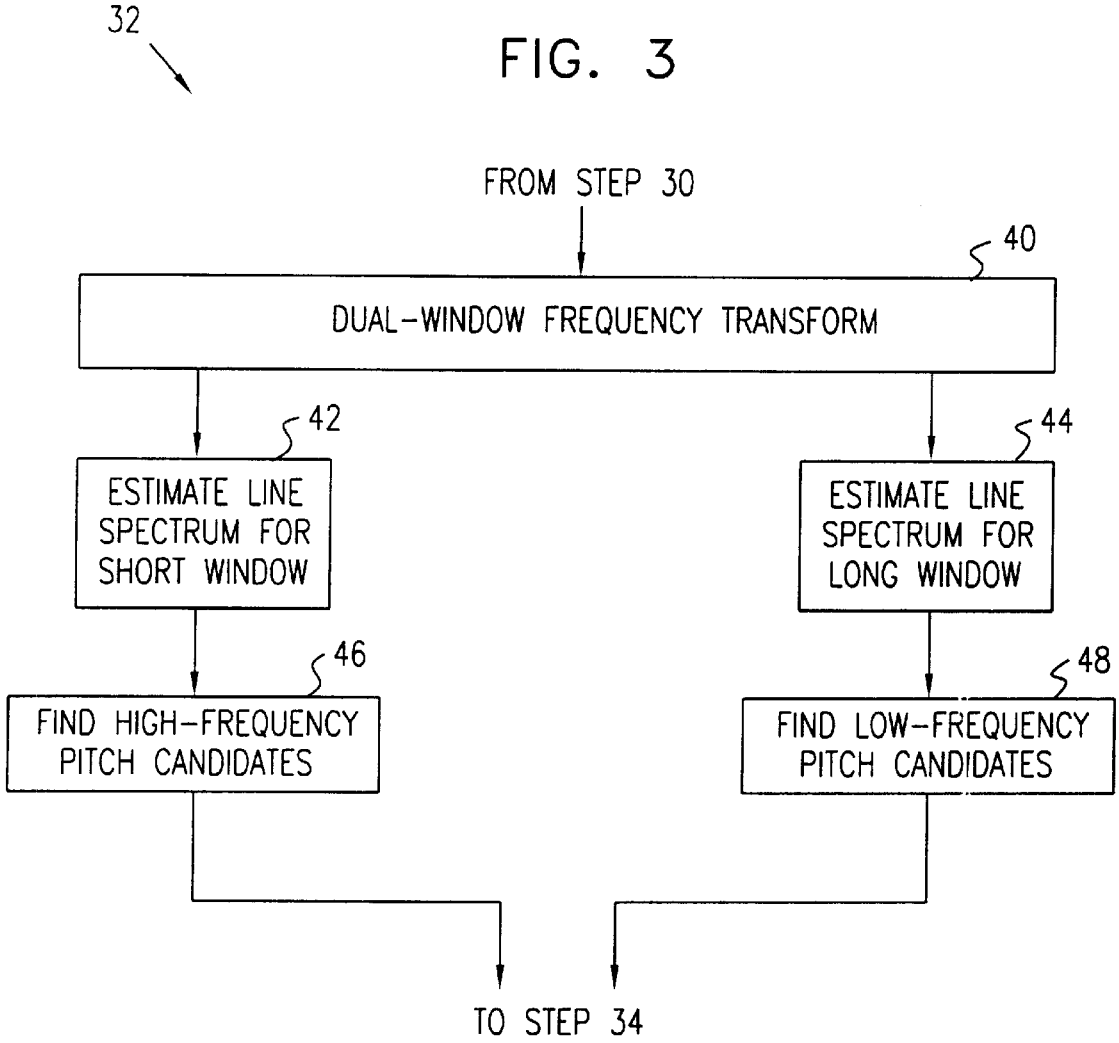
FIG. 3 is a flow chart that schematically illustrates a method for extracting line spectra and finding candidate pitch values for a speech signal, in accordance with a preferred embodiment of the present invention.

FIG. 3 is a flow chart that schematically illustrates details of pitch identification step 32, in accordance with a preferred embodiment of the present invention. At a transform step 40, a dual-window short-time Fourier transform (STFT) is applied to each frame of the speech signal. The range of possible pitch frequencies for speech signals is typically from 55 to 420 Hz. This range is preferably divided into two regions: a lower region from 55 Hz up to a middle frequency $F_b$ (typically about 90 Hz), and an upper region from $F_b$ up to 420 Hz. As described hereinbelow, for each frame a short time window is defined for searching the upper frequency region, and a long time window is defined for the lower frequency region. Alternatively, a greater number of adjoining windows may be used. The STFT is applied to each of the time windows to calculate respective high- and low-frequency spectra of the speech signal.

Processing of the short- and long-window spectra proceeds on separate, parallel tracks. At spectrum estimation steps 42 and 44, high- and low-frequency line spectra, having the form $\{(a_i, \theta_i)\}$, defined above, are derived from the respective STFT results. The line spectra are used at candidate frequency finding steps 46 and 48 to find respective sets of high- and low-frequency candidate values of the pitch. The pitch candidates are fed to step 34 (FIG. 2) for selection of the best pitch frequency estimate among the candidates. Details of steps 40 through 48 are described hereinbelow with reference to FIGS. 4, 5 and 6.

Figure 4:
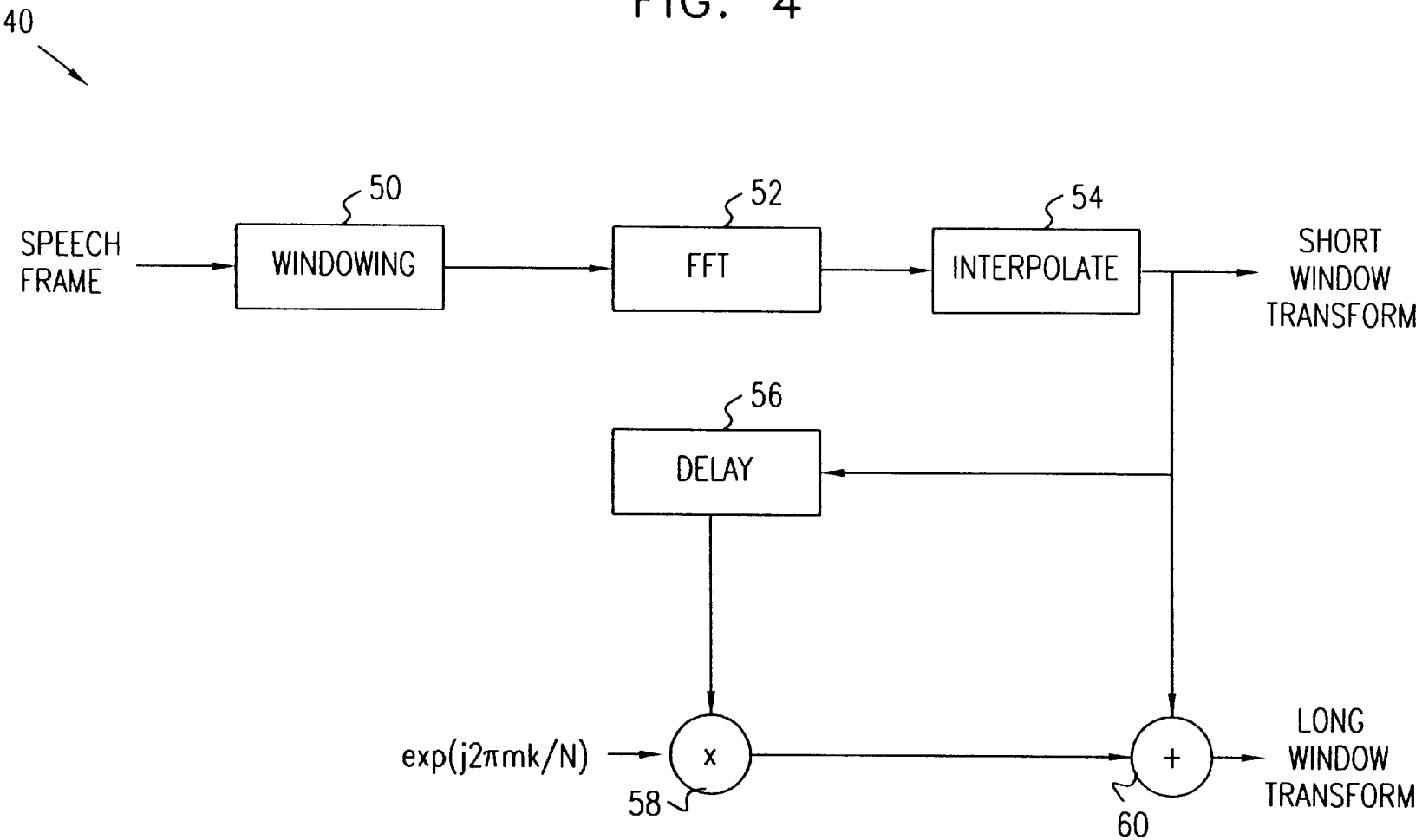
FIG. 4 is a block diagram that schematically illustrates a method for extraction of line spectra over long and short time intervals simultaneously, in accordance with a preferred embodiment of the present invention.

FIG. 4 is a block diagram that schematically illustrates details of transform step 40, in accordance with a preferred embodiment of the present invention. A windowing block 50 applies a windowing function, preferably a Hamming window 20 ms in duration, as is known in the art, to the current frame of the speech signal. A transform block 52 applies a suitable frequency transform to the windowed frame, preferably a Fast Fourier Transform (FFT) with a resolution of 256 or 512 frequency points, dependent on the sampling rate.

Preferably, the output of block 52 is fed to an interpolation block 54, which is used to increase the resolution of the spectrum. Most preferably, the interpolation is performed by applying a Dirichlet kernel $$D(\theta, N) = \frac{\sin(N\theta/2)}{\sin(\theta/2)}$$

to the FFT output coefficients $X^d[k]$, giving interpolated spectral coefficients:

$$X(\theta) = \sum_{k=0}^{N-1} \frac{1}{N} X^d[k] D(\theta - 2\pi k/N, N) \exp\{-j(\theta - 2\pi k/N)(N-1)/2\} \tag{2}$$

For efficient interpolation, a small number of coefficients $X^d[k]$ are used in a near vicinity of each frequency $\theta$. Typically, 16 coefficients are used, and the resolution of the spectrum is increased in this manner by a factor of two, so that the number of points in the interpolated spectrum is L=2N. The output of block 54 gives the short window transform, which is passed to step 42 (FIG. 3).

The long window transform to be passed to step 44 is calculated by combining the short window transforms of the current frame, $X^s$, and of the previous frame, $Y^s$, which is held by a delay block 56. Before combining, the coefficients from the previous frame are multiplied by a phase shift of $2\pi mk/L$, at a multiplier 58, wherein m is the number of samples in a frame. The long-window spectrum $X^1$ is generated by adding the short-window coefficients from the current and previous frames (with appropriate phase shift) at an adder 60, giving:

$$X^1(2\pi k/L) = X^s(2\pi k/L) + Y^s(2\pi k/L)\exp(j2\pi mk/L) \tag{3}$$

Here k is an integer taken from a set of integers such that the frequencies $2\pi k/L$ span the full range of frequencies. The method exemplified by FIG. 4 thus allows spectra to be derived for multiple, overlapping windows with little more computational effort that is required to perform a STFT operation on a single window.

Figure 5:
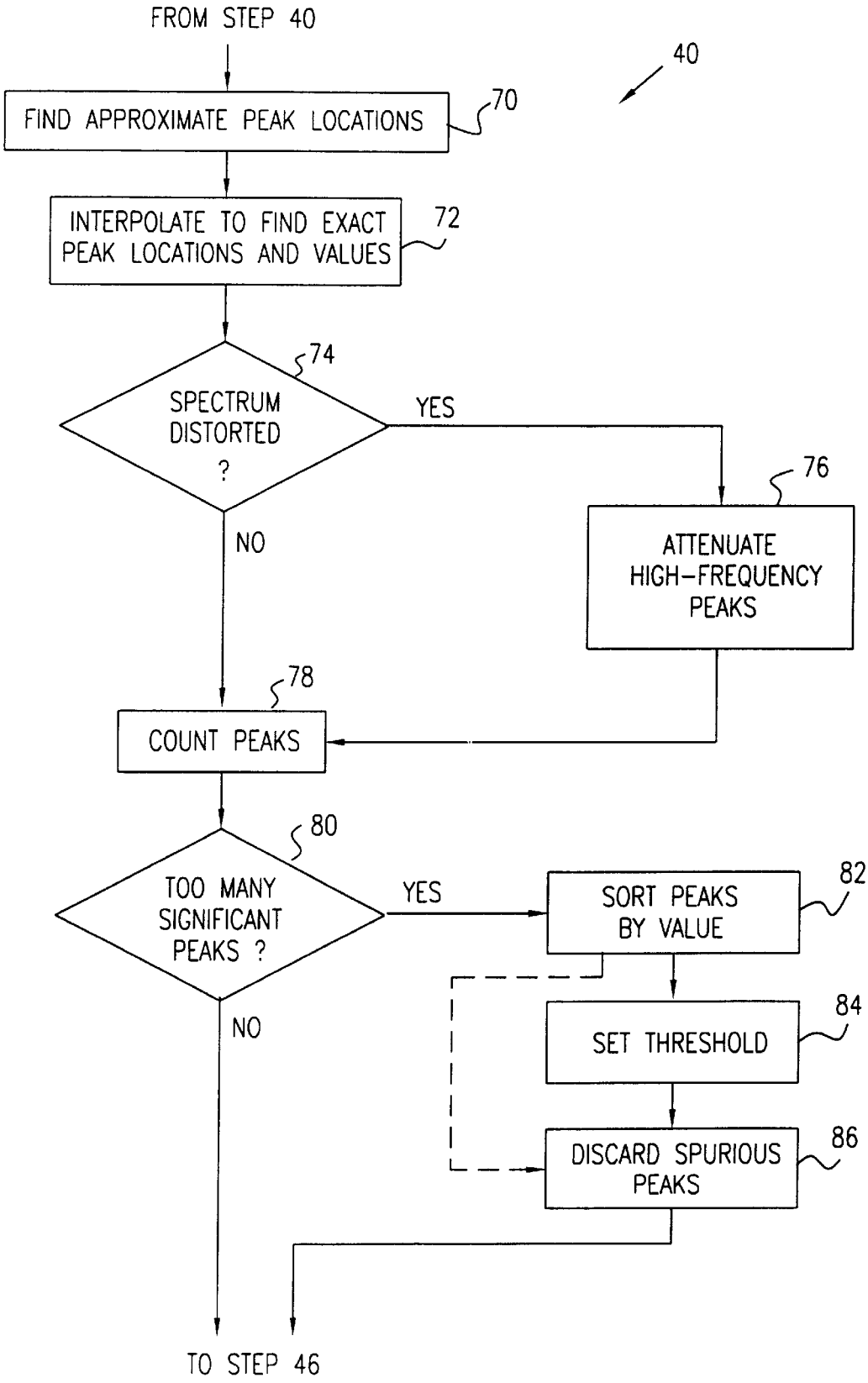
FIG. 5 is a flow chart that schematically illustrates a method for finding peaks in a line spectrum, in accordance with a preferred embodiment of the present invention.

FIG. 5 is a flow chart that schematically shows details of line spectrum estimation steps 42 and 44, in accordance with a preferred embodiment of the present invention. The method of line spectrum estimation illustrated in this figure is applied to both the long-and short-window transforms $X(\theta)$ generated at step 40. The object of steps 42 and 44 is to determine an estimate $\{(|\hat{a}_i|, \hat{\theta})\}$, of the absolute line spectrum of the current frame. The sequence of peak frequencies $\{\hat{\theta}_i\}$ is derived from the locations of the local maxima of $X(\theta)$, and $|\hat{a}_i|=|X(\hat{\theta}_i)|$. The estimate is based on the assumption that the width of the main lobe of the transform of the windowing function (block 50) in the frequency domain is small compared to the pitch frequency. Therefore, the interaction between adjacent windows in the spectrum is small.

Estimation of the line spectrum begins with finding approximate frequencies of the peaks in the interpolated spectrum (per equation (2)), at a peak finding step 70. Typically, these frequencies are computed with integer precision. At an interpolation step 72, the peak frequencies are calculated to floating point precision, preferably using quadratic interpolation based on the frequencies of the peaks in integer multiples of $2\pi/L$ and the amplitude of the spectrum at the three nearest neighboring integer multiples. Linear interpolation is applied to the complex amplitude values to find the amplitudes at the precise peak locations, and the absolute values of the amplitudes are then taken.

At a distortion evaluation step 74, the array of peaks found in the preceding steps is processed to assess whether distortion was present in the input speech signal and, if so, to attempt to correct the distortion. Preferably, the analyzed frequency range is divided into three equal regions, and for each region, the maximum of all amplitudes in the region is computed. The regions completely cover the frequency range. If the maximum value in either the middle- or the high-frequency range is too high compared to that in the low-frequency range, the values of the peaks in the middle and/or high range are attenuated, at an attenuation step 76. It has been found heuristically that attenuation should be applied if the maximum value for the middle-frequency range is more than 65% of that in the low-frequency range, or if the maximum in the high-frequency range is more than 45% of that in the low-frequency range. Attenuating the peaks in this manner "restores" the spectrum to a more likely shape. Roughly speaking, if the speech signal was not distorted initially, step 74 will not change its spectrum.

The number of peaks found at step 72 is counted, at a peak counting step 78. At a dominant peak evaluation step 80, the number of peaks is compared to a predetermined maximum number, which is typically set to eight. If eight or fewer peaks are found, the process proceeds directly to step 46 or 48. Otherwise, the peaks are sorted in descending order of their amplitude values, at a sorting step 82. Once a predetermined number of the highest peaks have been found (typically equal to the maximum number of peaks used at step 80), a threshold is set equal to a certain fraction of the amplitude value of the lowest peak in this group of the highest peaks, at a threshold setting step 84. Peaks below this threshold are discarded, at a spurious peak discarding step 86. Alternatively, if at some stage of sorting step 82, the sum of the sorted peak values exceeds a predetermined fraction, typically 95%, of the total sum of the values of all of the peaks that were found, the sorting process stops. All of the remaining, smaller peaks are then discarded at step 86. The purpose of this step is to eliminate small, spurious peaks that may subsequently interfere with pitch determination or with the voiced/unvoiced decision at steps 34 and 36 (FIG. 2). Reducing the number of peaks in the line spectrum also makes the process of pitch determination more efficient.

Figure 6:
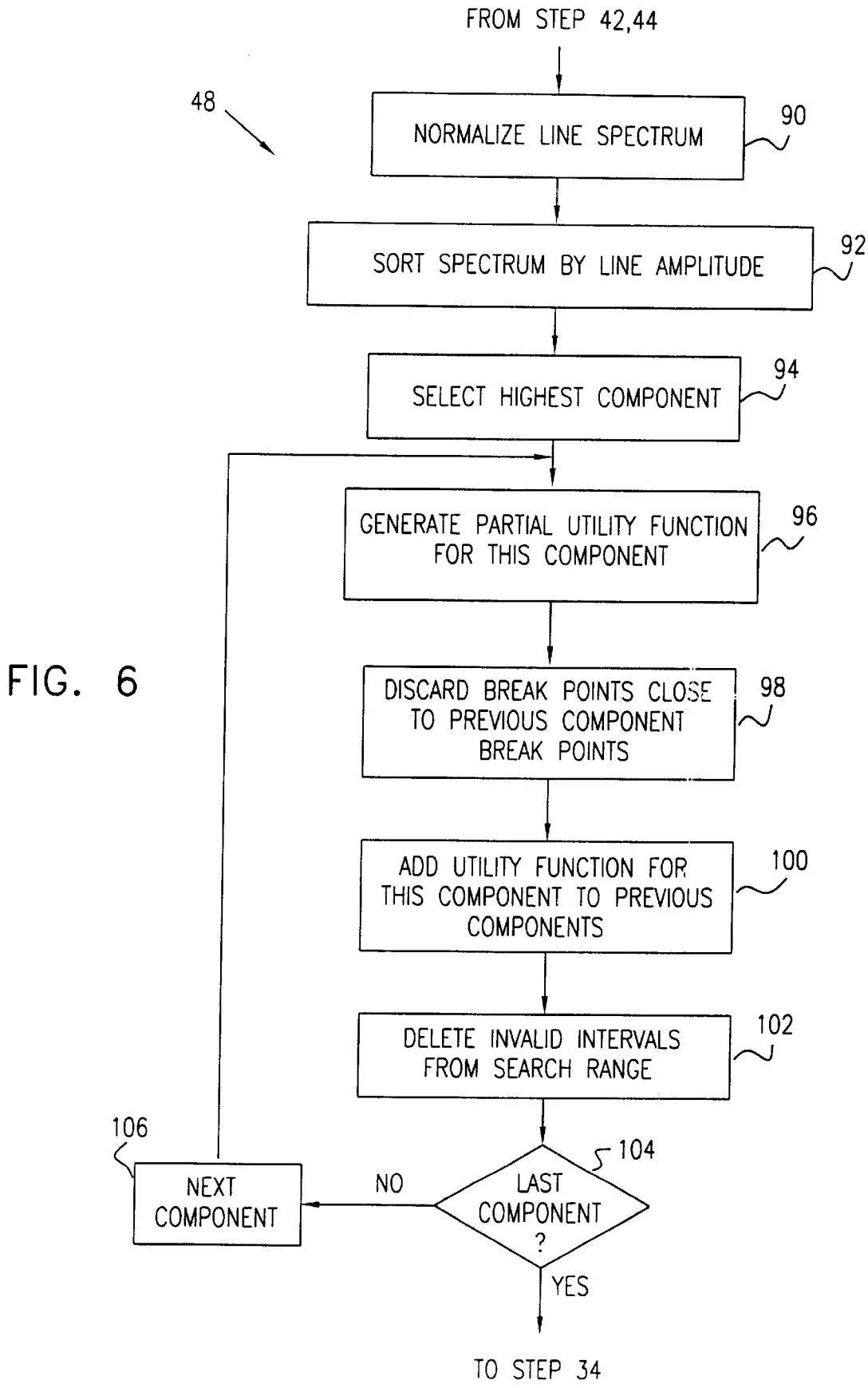
FIG. 6 is a flow chart that schematically illustrates a method for evaluating candidate pitch frequencies based on an input line spectrum, in accordance with a preferred embodiment of the present invention.

FIG. 6 is a flow chart that schematically shows details of candidate frequency finding steps 46 and 48, in accordance with a preferred embodiment of the present invention. These steps are applied respectively to the short- and long-window line spectra $\{(|\hat{a}_i|, \hat{\theta}_i)\}$ output by steps 42 and 44, as shown and described above. In step 46, pitch candidates whose frequencies are higher than a certain threshold are generated, and their utility functions are computed using the procedure outlined below based on the line spectrum generated in the short analysis interval. In step 48, the line spectrum generated in the long analysis interval also generates a pitch candidate list and computes utility functions only for pitch candidates whose frequency is lower than that threshold. For both the long and short windows, the line spectra are normalized, at a normalization step 90, to yield lines with normalized amplitudes $b_i$ and frequencies $f_i$ given by:

$$b_i = \frac{|\hat{a}_i|}{\sum_{k=1}^{K} |\hat{a}_k|} \tag{4}$$

$$f_i = \frac{\hat{\theta}_i}{2\pi T_s} \tag{5}$$

In both equations, i runs from 1 to K, and $T_s$ is the sampling interval. In other words, $1/T_s$ is the sampling frequency of the original speech signal, and $f_i$ is thus the frequency in samples per second of the spectral lines. The lines are sorted according to their normalized amplitudes $b_i$, at a sorting step 92.

Figure 7:
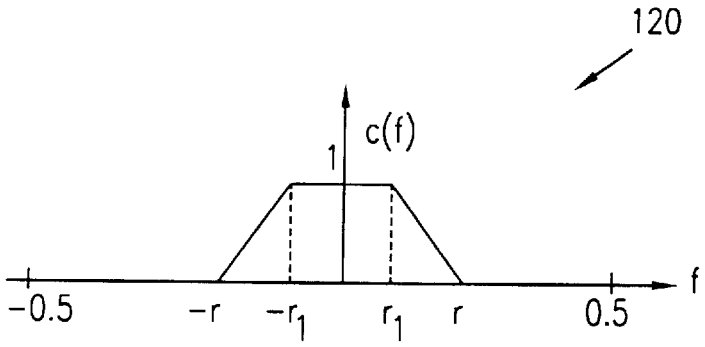
FIG. 7 is a plot of one cycle of an influence function used in evaluating the candidate pitch frequencies in accordance with the method of FIG. 6.

FIG. 7 is a plot showing one cycle of an influence function 120, identified as c(f), used at this stage in the method of FIG. 6, in accordance with a preferred embodiment of the present invention. The influence function preferably has the following characteristics:

1. $c(f+1)=c(f)$, i.e., the function is periodic, with period 1.
2. $0 \leqq c(f) \leqq 1$
3. $c(0)=1$.
4. $c(f)=c(-f)$.
5. $c(f)=0$ for $r \leqq |f| \leqq 1/2$, wherein r is a parameter $<1/2$.
6. c(f) piecewise linear and non-increasing in [0,r]. In the preferred embodiment shown in FIG. 7, the influence function is trapezoidal, with the form:

$$c(f) = \begin{cases} 1 & f \in [-r_1, r_1] \\ 1 - (|f| - r_1)/(r - r_1) & |f| \in [r_1, r] \\ 0 & r < |f| < 0.5 \end{cases} \tag{6}$$

Alternatively, another periodic function may be used, preferably a piecewise linear function whose value is zero above some predetermined distance from the origin.

Figure 8:
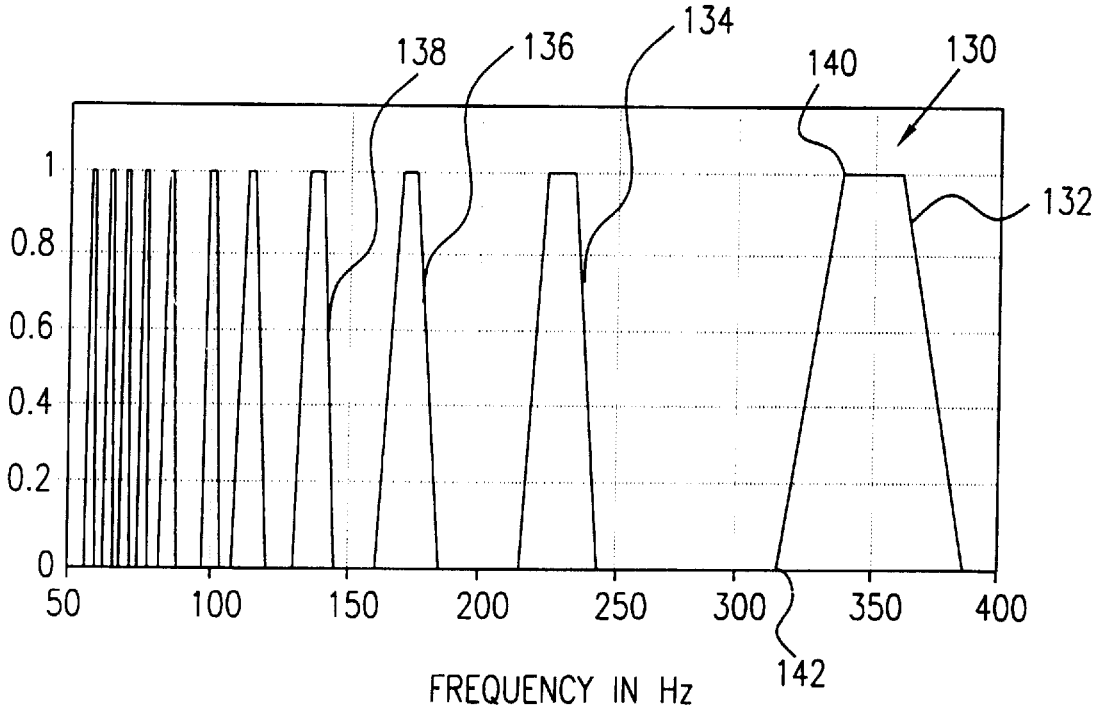
FIG. 8 is a plot of a partial utility function derived by applying the influence function of FIG. 7 to a component of a line spectrum, in accordance with a preferred embodiment of the present invention.

FIG. 8 is a plot showing a component 130 of a utility function $U(f_p)$, which is generated for candidate pitch frequencies $f_p$ using the influence function c(f), in accordance with a preferred embodiment of the present invention. The utility function $U(f_p)$ for any given pitch frequency is generated based on the line spectrum $\{(b_i, f_i)\}$, as given by:

$$U(f_p) = \sum_{i=1}^{K} b_i c\left(\frac{f_i}{f_p}\right) \tag{7}$$

A component of this function, $U_i(f_p)$, is then defined for a single spectral line $(b_i, f_i)$ as:

$$U_i(f_p) = b_i c\left(\frac{f_i}{f_p}\right) \tag{8}$$

FIG. 8 shows one such component, wherein $f_i$=700 Hz, and the component is evaluated over pitch frequencies in the range from 50 to 400 Hz. The component comprises a plurality of lobes 132, 134, 136, 138, . . . , each defining a region of the frequency range in which a candidate pitch frequency could occur and give rise to the spectral line at $f_i$.

Because the values $b_i$ are normalized, and $c(f) \leqq 1$, the utility function for any given candidate pitch frequency will be between zero and one. Since $c(f_i/f_p)$ is by definition periodic in $f_i$ with period $f_p$, a high value of the utility function for a given pitch frequency $f_p$ indicates that most of the frequencies in the sequence $\{f_i\}$ are close to some multiple of the pitch frequency. Thus, the pitch frequency for the current frame could be found in a straightforward (but inefficient) way by calculating the utility function for all possible pitch frequencies in an appropriate frequency range with a specified resolution, and choosing a candidate pitch frequency with a high utility value.

A more efficient method is presented hereinbelow. Because the influence function c(f) is piecewise linear, the value of $U_i(f_p)$ at any point is defined by its value at break points of the function (i.e., points of discontinuity in the first derivative), such as points 140 and 142 shown in FIG. 8. Although $U_i(f_p)$ is itself not piecewise linear, it can be approximated as a linear function in all regions. The method described below uses the breakpoint values of the components $U_i(f_p)$ to build up the full utility function $U(f_p)$. Each component $U_i$ adds its own breakpoints to the full function, while values of the utility function between the breakpoints are found by linear interpolation.

The process of building up the full utility function uses a series of partial utility functions $PU_i$, generated by adding in the components $U_i(f_p)$ for each of the spectral lines $(b_i, f_i)$ in succession:

$$PU_i(f_p) = \sum_{k=1}^{i} U_k(f_p) \tag{9}$$

Because the function c(f) is no larger than one, the sum of the remaining values of the line spectrum after the first i lines have been added to the partial utility function is bounded from above by:

$$R_i = \sum_{k=i+1}^{K} b_k \tag{10}$$

Then for any i, the full utility function $U(f_p)$ is bounded by:

$$U(f_p) \leqq PU_i(f_p) + R_i \tag{11}$$

Therefore, after each iteration i, values of $f_p$ for which $PU_i(f_p)+R_i$ is less than a predetermined threshold are guaranteed to have a utility value which is also less than the threshold. They may therefore be eliminated from further consideration as candidates to be the correct pitch frequency. By using the break point values of $PU_i$, with linear interpolation to find the value of the function between the break points, entire intervals over which $PU_i(f_p)+R_i$ is below threshold can be found and eliminated at each iteration, making the subsequent search more efficient.

Returning now to FIG. 6, the influence function c(f) is applied iteratively to each of the lines $(b_i, f_i)$ in the normalized spectrum in order to generate the succession of partial utility functions $PU_i$. The process begins with the highest component $U_1(f_p)$, at a component selection step 94. This component corresponds to the sorted spectral line $(b_1, f_1)$ having the highest normalized amplitude $b_1$. The value of $U_1(f_p)$ is calculated at all of its break points over the range of search for $f_p$, at a utility function generation step 96. The partial utility function $PU_1$ at this stage is simply equal to $U_1$. In subsequent iterations at this step, the new component $U_i(f_p)$ is determined both at its own break points and at all break points of the partial utility function $PU_{i-1}(f_p)$ that are within the current valid search intervals for $f_p$ (i.e., within an interval that has not been eliminated in a previous iteration). The values of $U_i(f_p)$ at the break points of $PU_i-1(f_p)$ are preferably calculated by interpolation. The values of $PU_{i-1}(f_p)$ are likewise calculated at the break points of $U_i(f_p)$. If $U_i$ contains break points that are very close to existing break points in $PU_{i-1}$, these new break points are preferably discarded as superfluous, at a discard step 98. Most preferably, break points whose frequency differs from that of an existing break point by no more than $0.0006*f_p^2$ are discarded in this manner. $U_i$ is then added to $PU_{i-1}$ at all of the remaining break points, thus generating $PU_i$, at an addition step 100.

In each iteration, the valid search range for $f_p$ is evaluated at an interval deletion step 102. As noted above, intervals in which $PU_i(f_p)+R_i$ is less than a predetermined threshold are eliminated from further consideration. A convenient threshold to use for this purpose is a voiced/unvoiced threshold $T_{uv}$, which is applied to the selected pitch frequency at step 36 (FIG. 2) to determine whether the current frame is voiced or unvoiced. The use of a high threshold at this point increases the efficiency of the calculation process, but at the risk of deleting valid candidate pitch frequencies. This could result in a determination that the current frame is unvoiced, when in fact it should be considered voiced. For example, when the utility value of the estimated pitch frequency of the preceding frame, $U(\hat{F}_0)$, was high, the current frame should sometimes be judged to be voiced even if the current-frame utility value is low.

For this reason, an adaptive heuristic threshold $T_{ad}$ is preferably defined for use at step 102 as follows:

$$T_{ad} = \max\left\{\frac{PU_{max}}{\sum_{k=1}^{i} b_k} - (1 - T_{uv}),\ T_{min}\right\} \tag{12}$$

Here $PU_{max}$ is the maximum value of the current partial utility function $PU_i$, and $T_{min}$ is a predetermined minimum threshold, lower than $T_{uv}$. The quotient $$\frac{PU_{max}}{\sum_{k=1}^{i} b_k},$$

which will always be less than or equal to 1, represents a measure of the "quality" of the partial utility function $PU_i$. When the quality is high, the threshold $T_{ad}$ will be close to $T_{uv}$. When the quality is poor, the lower threshold $T_{min}$ prevents valid pitch candidates from being eliminated too early in the pitch determination process.

At a termination step 104, when the component $U_i$ due to the last spectral line $(b_i, f_i)$ has been evaluated, the process is complete, and the resultant utility function U is passed to pitch selection step 34. The function has the form of a set of frequency break points and the values of the function at the break points. Otherwise, until the process is complete, the next line is taken, at a next component step 106, and the iterative process continues from step 96.

In conclusion, it will be observed that the method of FIG. 6 searches all possible pitch frequencies in the search range, but it does so with optimized efficiency, since at each iteration additional invalid search intervals are eliminated. The search thus iterates over successively smaller intervals of validity. Furthermore, the contribution of each component of the line spectrum to the utility function is calculated only at specific break points, and not over the entire search range of pitch frequencies.

Figure 9A:
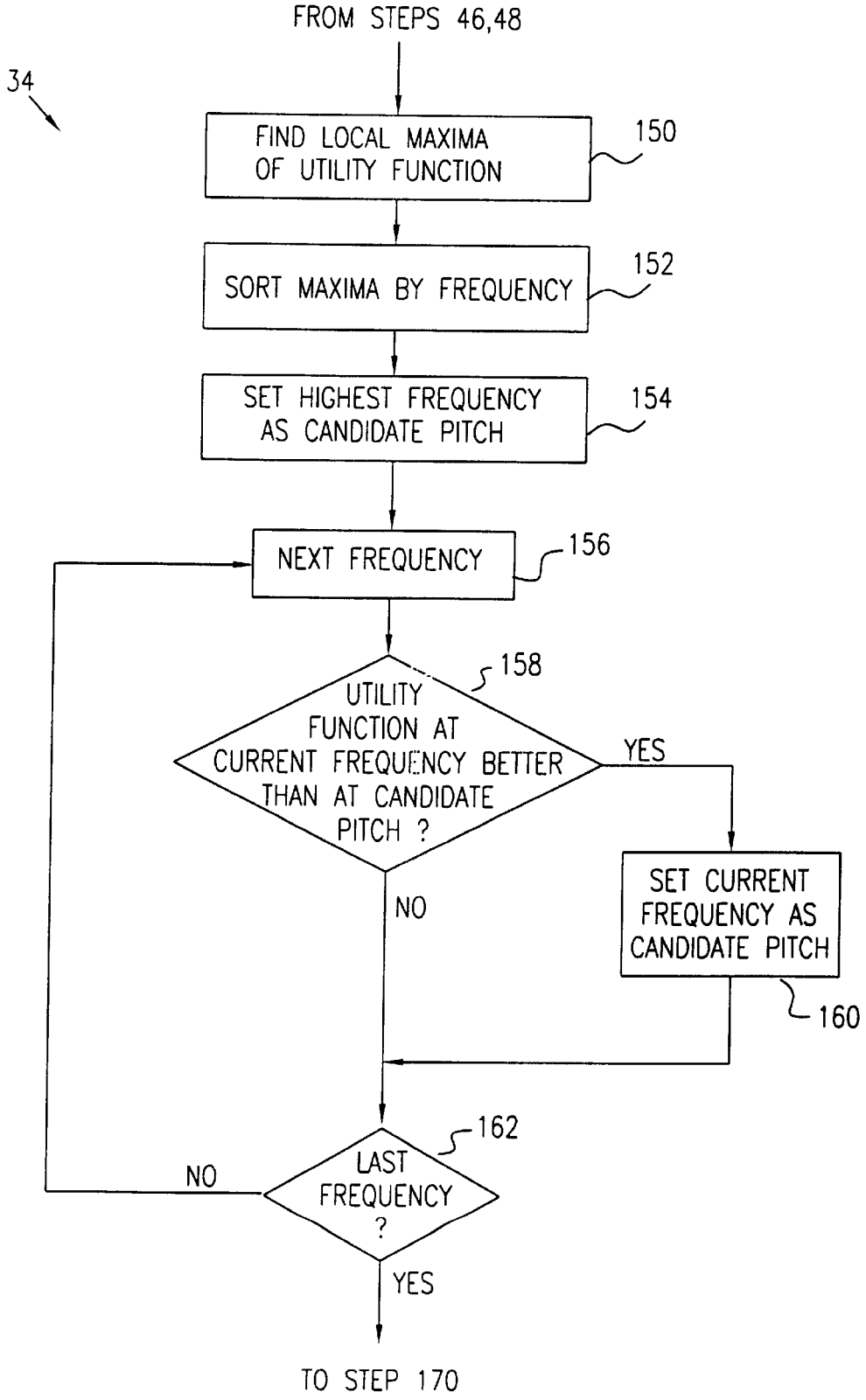
FIGS. 9A and 9B are flow charts that schematically illustrate a method for selecting an estimated pitch frequency for a frame of speech from among a plurality of candidate pitch frequencies, in accordance with a preferred embodiment of the present invention.
Figure 9B:
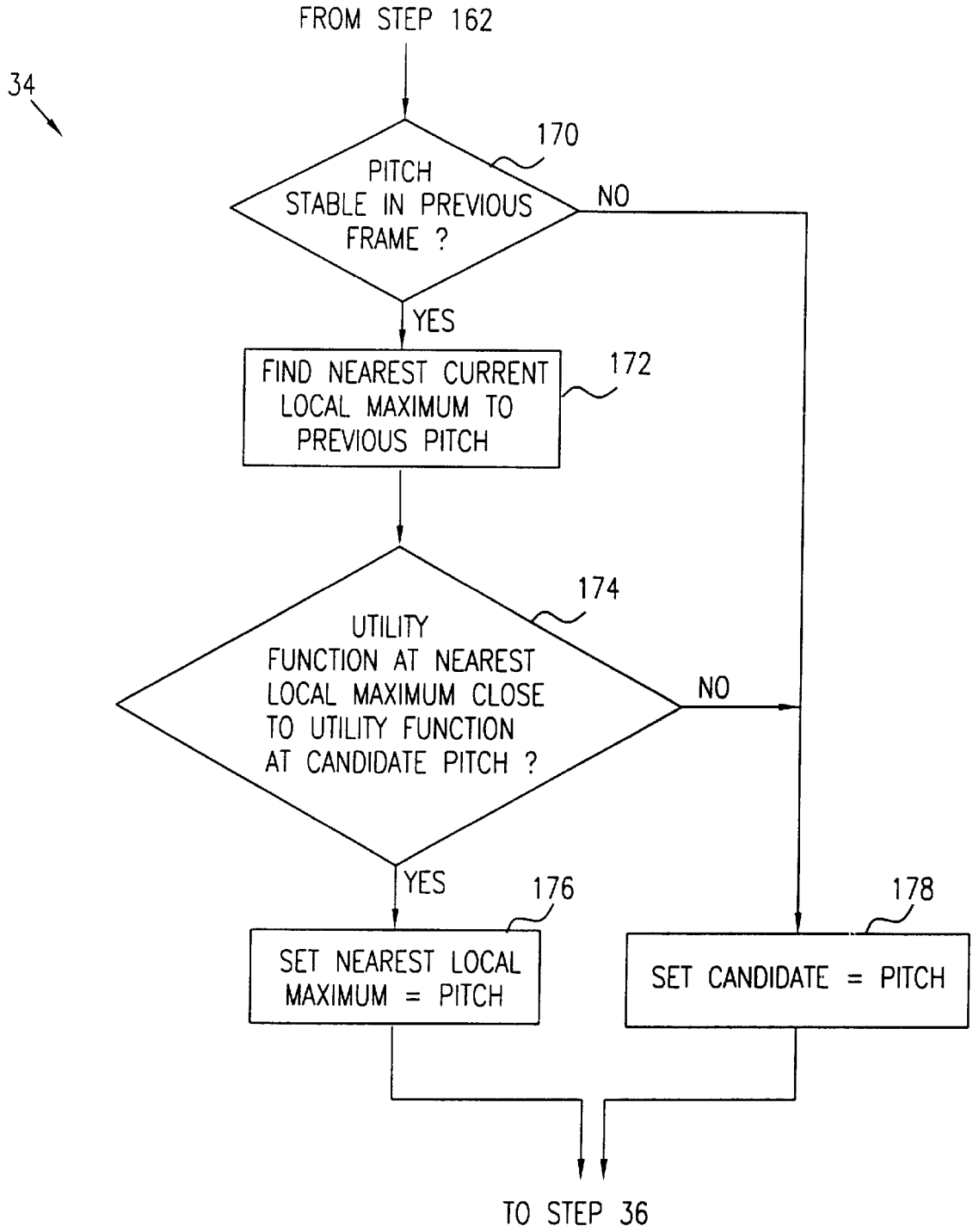

FIGS. 9A and 9B are flow charts that schematically illustrate details of pitch selection step 34 (FIG. 2), in accordance with a preferred embodiment of the present invention. The selection of the best candidate pitch frequency is based on the utility function output from step 104, including all break points that were found. The break points of the utility function are evaluated, and one of them is chosen as the best pitch candidate.

At a maximum finding step 150, the local maxima of the utility function are found. The best pitch candidate is to be selected from among these local maxima. Typically, preference is given to high pitch frequencies, in order to avoid mistaking integer dividends of the pitch frequency (corresponding to integer multiples of the pitch period) for the true pitch. Therefore, at a frequency sorting step 152, the local maxima $\{f_p^i\}_{i=1}^{m}$ are sorted by frequency such that:

$$f_p^1 > f_p^2 > \ldots > f_p^M \tag{13}$$

The estimated pitch $\hat{F}_0$ is set initially to be equal to the highest-frequency candidate $f_p^1$, at an initialization step 154. Each of the remaining candidates is evaluated against the current value of the estimated pitch, in descending frequency order.

The process of evaluation begins at a next frequency step 156, with candidate pitch $f_p^2$. At an evaluation step 158, the value of the utility function, $U(f_p^2)$, is compared to $U(\hat{F}_0)$. If the utility function at $f_p^2$ is greater than the utility function at $\hat{F}_0$ by at least a threshold difference $T_1$, or if $f_p^2$ is near $\hat{F}_0$ and has a greater utility function by even a minimal amount, then $f_p^2$ is considered to be a superior pitch frequency estimate to the current $\hat{F}_0$. Typically, $T_1=0.1$, and $f_p^2$ is considered to be near $\hat{F}_0$ if $1.17f_p^2>\hat{F}_0$. In this case, $\hat{F}_0$ is set to the new candidate value, $f_p^2$, at a candidate setting step 160. Steps 156 through 160 are repeated in turn for all of the local maxima $f_p^i$, until the last frequency $f_p^M$ is reached, at a last frequency step 162.

It is generally desirable to choose a pitch for the current frame that is near the pitch of the preceding frame, as long as the pitch was stable in the preceding frame. Therefore, at a previous frame assessment step 170, it is determined whether the previous frame pitch was stable. Preferably, the pitch is considered to have been stable if over the six previous frames, certain continuity criteria are satisfied. It may be required, for example, that the pitch change between consecutive frames was less than 18%, and a high value of the utility function was maintained in all of the frames. If so, the pitch frequency in the set $\{f_p^i\}$ that is closest to the previous pitch frequency is selected, at a nearest maximum selection step 172. The utility function at this closest frequency $U(f_p^{close})$ is evaluated against the utility function of the current estimated pitch frequency $U(\hat{F}_0)$, at a comparison step 174. If the values of the utility function at these two frequencies differ by no more than a threshold amount $T_2$, then the closest frequency to the preceding pitch frequency, $f_p^{close}$, is chosen to be the estimated pitch frequency $\hat{F}_0$ for the current frame, at a nearest frequency setting step 176. Typically $T_2$ is set to be 0.06. Otherwise, if the values of the utility function differ by more than $T_2$, the current estimated pitch frequency $\hat{F}_0$ from step 162 remains the chosen pitch frequency for the current frame, at a candidate frequency setting step 178. This estimated value is likewise chosen if the pitch of the previous frame was found to be unstable at step 170.

Figure 10:
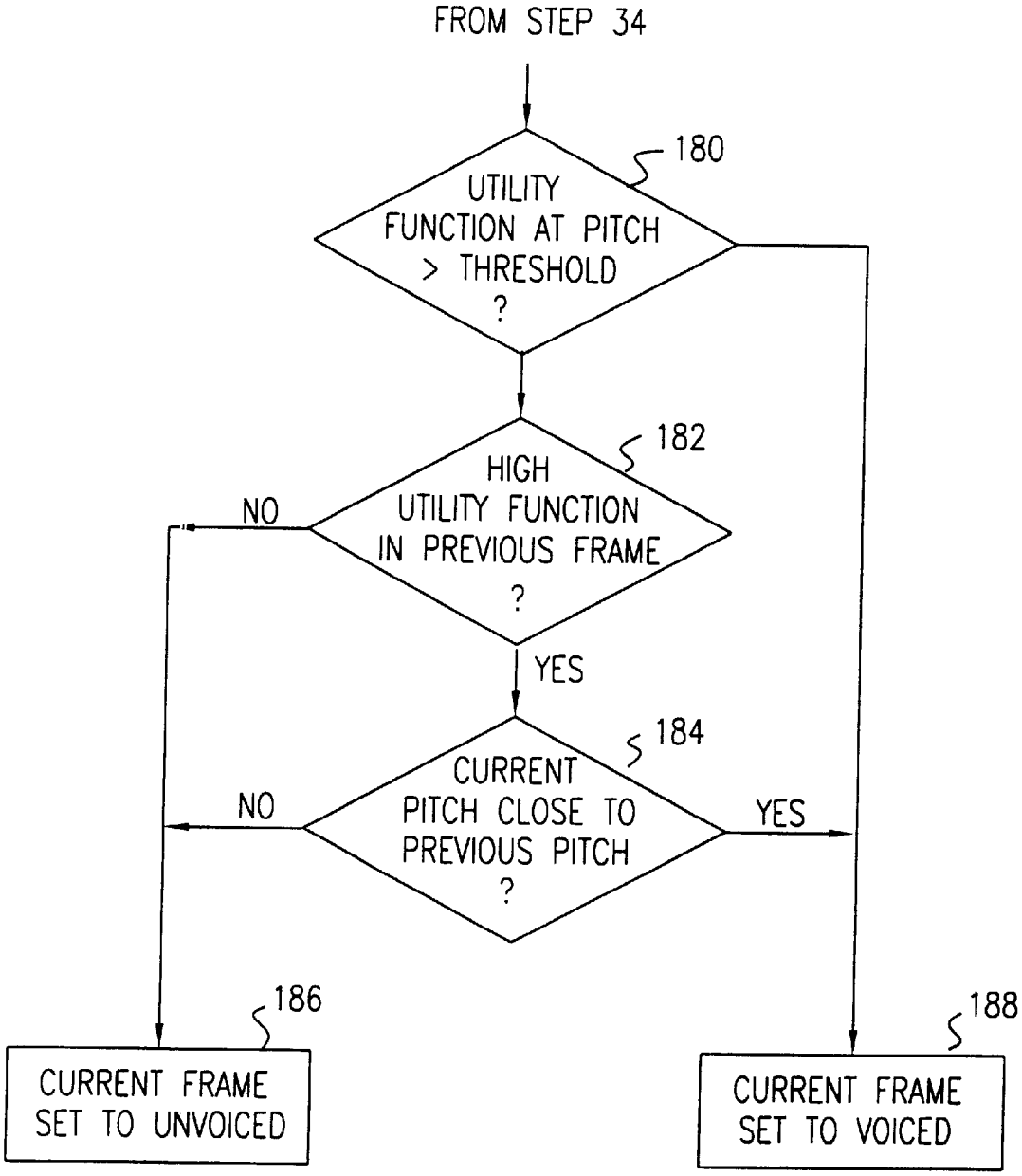
FIG. 10 is a flow chart that schematically illustrates a method for determining whether a frame of speech is voiced or unvoiced, in accordance with a preferred embodiment of the present invention.

FIG. 10 is a flow chart that schematically shows details of voicing decision step 36, in accordance with a preferred embodiment of the present invention. The decision is based on comparing the utility function at the estimated pitch, $U(\hat{F}_0)$, to the above-mentioned threshold $T_{uv}$, at a threshold comparison step 180. Typically, $T_{uv}=0.75$. If the utility function is above the threshold, the current frame is classified as voiced, at a voiced setting step 188.

During transitions in a speech stream, however, the periodic structure of the speech signal may change, leading at times to a low value of the utility function even when the current frame should be considered voiced. Therefore, when the utility function for the current frame is below the threshold $T_{uv}$, the utility function of the previous frame is checked, at a previous frame checking step 182. If the estimated pitch of the previous frame had a high utility value, typically at least 0.84, and the pitch of the current frame is found, at a pitch checking step 184, to be close to the pitch of the previous frame, typically differing by no more than 18%, then the current frame is classified as voiced, at step 188, despite its low utility value. Otherwise, the current frame is classified as unvoiced, at an unvoiced setting step 186.

It will be appreciated that the preferred embodiments described above are cited by way of example, and that the present invention is not limited to what has been particularly shown and described hereinabove. Rather, the scope of the present invention includes both combinations and subcombinations of the various features described hereinabove, as well as variations and modifications thereof which would occur to persons skilled in the art upon reading the foregoing description and which are not disclosed in the prior art.

We claim:

1. A method for estimating a pitch frequency of a speech signal, comprising:

computing a first transform of the speech signal to a frequency domain over a first time interval;

computing a second transform of the speech signal to the frequency domain over a second time interval, which contains the first time interval; and estimating the pitch frequency of the speech signal responsive to the first and second transforms, wherein the first and second transforms comprise Short Time Fourier Transforms.

2. A method according to claim 1, wherein the first time interval comprises a current frame of the speech signal, and the second time interval comprises the current frame and a preceding frame, and wherein computing the second transform comprises combining the first transform with a transform computed over the preceding frame.

3. A method according to claim 2, wherein the transforms generate respective spectral coefficients, and wherein combining the first transform with the transform computed over the preceding frame comprises applying a phase shift to the coefficients generated by the transform computed over the preceding frame and adding the phase-shifted coefficients to the coefficients generated by the first transform.

4. A method according to claim 3, wherein for a given frequency, the phase shift applied to the corresponding coefficient is proportional to the frequency and to a duration of the frame.

5. A method according to claim 1, wherein estimating the pitch frequency comprises deriving first and second line spectra of the signal from the first and second transforms, respectively, and determining the pitch frequency based on the line spectra.

6. A method according to claim 5, wherein determining the pitch frequency comprises deriving first and second candidate pitch frequencies from the first and second line spectra, respectively, and choosing one of the first and second candidates as the pitch frequency.

7. A method according to claim 6, wherein deriving the first and second candidates comprises defining high and low ranges of possible pitch frequencies, and finding the first candidate in the high range and the second candidate in the low range.

8. A method according to claim 5, wherein the line spectra comprise spectral lines having respective line frequencies, and wherein determining the pitch frequency comprises computing a function that is periodic in the line frequencies, which function is indicative of the pitch frequency.

9. A method according to claim 1, and comprising encoding the speech signal responsive to the estimated pitch frequency.

10. A method for estimating a pitch frequency of a speech signal, comprising:

finding a line spectrum of the speech signal, the spectrum comprising spectral lines having respective line amplitudes and line frequencies;

computing a utility function, which is indicative, for each candidate pitch frequency in a given pitch frequency range, of a compatibility of the spectrum with the candidate pitch frequency, the utility function comprising at least one influence function that is periodic in a ratio of the frequency of one of the spectral lines to the candidate pitch frequency; and estimating the pitch frequency of the speech signal responsive to the utility function.

11. A method according to claim 10, wherein computing the at least one influence function comprises computing a function of the ratio having maxima at integer values of the ratio and minima therebetween.

12. A method according to claim 10, wherein computing the at least one influence function comprises computing respective influence functions for multiple lines in the spectrum, and wherein computing the utility function comprises computing a superposition of the influence functions.

13. A method according to claim 10, wherein estimating the pitch frequency comprises choosing a candidate pitch frequency at which the utility function has a local maximum.

14. A method according to claim 13, wherein the candidate pitch frequency is one of a plurality of frequencies at which the utility function has local maxima, and wherein choosing the candidate pitch frequency comprises preferentially selecting one of the maxima because it has a higher frequency than another one of the maxima.

15. A method according to claim 13, wherein the candidate pitch frequency is one of a plurality of frequencies at which the utility function has local maxima, and wherein choosing the candidate pitch frequency comprises preferentially selecting one of the maxima because it is near in frequency to a previously estimated pitch frequency of a preceding frame of the speech signal.

16. A method according to claim 13, and comprising determining whether the speech signal is voiced or unvoiced by comparing a value of the local maximum to a predetermined threshold.

17. A method according to claim 10, and comprising encoding the speech signal responsive to the estimated pitch frequency.

18. A method for estimating a pitch frequency of a speech signal, comprising:

finding a line spectrum of the signal, the spectrum comprising spectral lines having respective line amplitudes and line frequencies;

computing a utility function that is periodic in the frequencies of the lines in the spectrum, which function is indicative, for each candidate pitch frequency in a given pitch frequency range, of a compatibility of the spectrum with the candidate pitch frequency; and estimating the pitch frequency of the speech signal responsive to the utility function, wherein computing the utility function comprises computing at least one influence function that is periodic in a ratio of the frequency of one of the spectral lines to the candidate pitch frequency, and wherein computing the at least one influence function comprises computing a function of the ratio having maxima at integer values of the ratio and minima therebetween, and wherein computing the function of the ratio comprises computing values of a piecewise linear function c(f), having a maximum value in a first interval surrounding f=0, a minimum value in a second interval surrounding f=1/2, and a value that varies linearly in a transition interval between the first and second intervals.

19. A method for estimating a pitch frequency of a speech signal, comprising:

finding a line spectrum of the speech signal, the spectrum comprising spectral lines having respective line amplitudes and line frequencies;

computing a utility function that is periodic in the frequencies of the lines in the spectrum, which function is indicative, for each candidate pitch frequency in a given pitch frequency range, of a compatibility of the spectrum with the candidate pitch frequency; and estimating the pitch frequency of the speech signal responsive to the utility function, wherein computing the utility function comprises computing at least one influence function that is periodic in a ratio of the frequency of one of the spectral lines to the candidate pitch frequency, and wherein computing the at least one influence function comprises computing respective influence functions for multiple lines in the spectrum, and wherein computing the utility function comprises computing a superposition of the influence functions, and wherein the respective influence functions comprise piecewise linear functions having break points, and wherein computing the superposition comprises calculating values of the influence functions at the break points, such that the utility function is determined by interpolation between the break points.

20. A method according to claim 19, wherein computing the respective influence functions comprises computing at least first and second influence functions for first and second lines in the spectrum in succession, and wherein computing the utility function comprises computing a partial utility function including the first influence function and then adding the second influence function to the partial utility function by calculating the values of the second influence function at the break points of the partial utility function and calculating the values of the partial utility function at the break points of the second influence function.

21. A method for estimating a pitch frequency of a speech signal, comprising:

finding a line spectrum of the speech signal, the spectrum comprising spectral lines having respective line amplitudes and line frequencies;

computing a utility function that is periodic in the frequencies of the lines in the spectrum, which function is indicative, for each candidate pitch frequency in a given pitch frequency range, of a compatibility of the spectrum with the candidate pitch frequency; and estimating the pitch frequency of the speech signal responsive to the utility function, wherein computing the utility function comprises computing at least one influence function that is periodic in a ratio of the frequency of one of the spectral lines to the candidate pitch frequency, and wherein computing the at least one influence function comprises computing respective influence functions for multiple lines in the spectrum, and wherein computing the utility function comprises computing a superposition of the influence functions, and wherein computing the respective influence functions comprises performing the following steps iteratively over the lines in the spectrum:

computing a first influence function for a first line in the spectrum;

responsive to the first influence function, identifying one or more intervals in the pitch frequency range that are incompatible with the spectrum;

defining a reduced pitch frequency range from which the one or more intervals have been eliminated; and computing a second influence function for a second line in the spectrum, while substantially restricting computation of the second influence function to pitch frequencies within the reduced range.

22. A method according to claim 21, wherein computing the superposition comprises calculating a partial utility function including the first influence function but not including the second influence function, and wherein identifying the one or more intervals comprises eliminating the intervals in which the partial utility function is below a specified level.

23. A method according to claim 22, wherein the specified level is determined responsive to the line amplitudes of the lines in the spectrum that are not included in the partial utility function.

24. A method according to claim 21, wherein performing the steps iteratively comprises iterating over the lines in the spectrum in order of decreasing amplitude.

25. Apparatus for estimating a pitch frequency of a speech signal, comprising an audio processor, which is adapted to compute a first transform of the speech signal to a frequency domain over a first time interval and a second transform of the speech signal to a frequency domain over a second time interval, which contains the first time interval, and to estimate the pitch frequency of the speech signal responsive to the first and second frequency transforms, wherein the first and second transforms comprise Short Time Fourier Transforms.

26. Apparatus according to claim 25, wherein the first time interval comprises a current frame of the speech signal, and the second time interval comprises the current frame and a preceding frame, and wherein the processor is adapted to compute the second transform by combining the first transform with a transform computed over the preceding frame.

27. Apparatus according to claim 25, wherein the processor is further adapted to encode the speech signal responsive to the estimated pitch frequency.

28. Apparatus for estimating a pitch frequency of a speech signal, comprising an audio processor, which is adapted to compute a first transform of the speech signal to a frequency domain over a first time interval and a second transform of the speech signal to a frequency domain over a second time interval, which contains the first time interval, and to estimate the pitch frequency of the speech signal responsive to the first and second frequency transforms, wherein the first time interval comprises a current frame of the speech signal, and the second time interval comprises the current frame and a preceding frame, and wherein the processor is adapted to compute the second transform by combining the first transform with a transform computed over the preceding frame, and wherein the transforms generate respective spectral coefficients, and wherein the processor is adapted to apply a phase shift to the coefficients generated by the transform computed over the preceding frame and to add the phase-shifted coefficients to the coefficients generated by the transform computed over the first time interval.

29. Apparatus according to claim 28, wherein for a given frequency, the phase shift applied to the corresponding coefficient is proportional to the frequency and to a duration of the frame.

30. Apparatus for estimating a pitch frequency of a speech signal, comprising an audio processor, which is adapted to compute a first transform of the speech signal to a frequency domain over a first time interval and a second transform of the speech signal to a frequency domain over a second time interval, which contains the first time interval, and to estimate the pitch frequency of the speech signal responsive to the first and second frequency transforms, wherein the processor is adapted to derive first and second line spectra of the signal from the first and second transforms, respectively, and to determine the pitch frequency based on the line spectra.

31. Apparatus according to claim 30, wherein the processor is adapted to derive first and second candidate pitch frequencies from the first and second line spectra, respectively, and to choose one of the first and second candidates as the pitch frequency.

32. Apparatus according to claim 31, wherein high and low ranges of possible pitch frequencies are defined, and the processor is adapted to derive the first candidate in the high range and the second candidate in the low range.

33. Apparatus according to claim 30, wherein the line spectra comprise spectral lines having respective line frequencies, and wherein the processor is adapted to generate a function that is periodic in the line frequencies, which function is indicative of the pitch frequency.

34. Apparatus for estimating a pitch frequency of a speech signal, comprising an audio processor, which is adapted to find a line spectrum of the speech signal, the spectrum comprising spectral lines having respective line amplitudes and line frequencies, to compute a utility function, which is indicative, for each candidate pitch frequency in a given pitch frequency range, of a compatibility of the spectrum with the candidate pitch frequency, the utility function comprising at least one influence function that is periodic in a ratio of the frequency of one of the spectral lines to the candidate pitch frequency, and to estimate the pitch frequency of the speech signal responsive to the periodic function.

35. Apparatus according to claim 34, wherein the at least one influence function comprises a function of the ratio having maxima at integer values of the ratio and minima therebetween.

36. Apparatus according to claim 34, wherein the processor is adapted to compute respective influence functions for multiple lines in the spectrum, and to compute the utility function by finding a superposition of the influence functions for use in estimating the pitch frequency.

37. Apparatus according to claim 36, wherein the influence functions comprise piecewise linear functions having break points, and wherein the processor is adapted to calculate values of the influence functions at the break points, such that the utility function is determined by interpolation between the break points.

38. Apparatus according to claim 37, wherein the influence functions comprise at least first and second influence functions, computed for first and second lines in the spectrum in succession, and wherein the processor is adapted to compute a partial utility function including the first influence function and then to add the second influence function to the partial utility function by calculating the values of the second influence function at the break points of the partial utility function and calculating the values of the partial utility function at the break points of the second influence function.

39. Apparatus according to claim 36, wherein the processor is adapted to perform the following steps iteratively over the lines in the spectrum:

computing a first influence function for a first line in the spectrum;

responsive to the first influence function, identifying one or more intervals in the pitch frequency range that are incompatible with the spectrum;

defining a reduced pitch frequency range from which the one or more intervals are eliminated; and computing a second influence function for a second line in the spectrum, while substantially restricting computation of the second influence function to pitch frequencies within the reduced range.

40. Apparatus according to claim 39, wherein the processor is adapted to calculate a partial utility function including the first influence function but not including the second influence function, and to eliminate the intervals in which the partial utility function is below a specified level from consideration in computing the second influence function.

41. Apparatus according to claim 40, wherein the specified level is determined responsive to the line amplitudes of the lines in the spectrum that are not included in the partial utility function.

42. Apparatus according to claim 39, wherein the processor is adapted to iterate over the lines in the spectrum in order of decreasing amplitude.

43. Apparatus according to claim 34, wherein the estimated pitch frequency comprises a pitch frequency at which the utility function has a local maximum.

44. Apparatus according to claim 43, wherein the candidate pitch frequency is one of a plurality of frequencies at which the utility function has local maxima, and wherein the processor is adapted to preferentially select as the candidate pitch frequency one of the maxima because it has a higher frequency than another one of the maxima.

45. Apparatus according to claim 43, wherein the candidate pitch frequency is one of a plurality of frequencies at which the periodic function has local maxima, and wherein the processor is adapted to preferentially select as the candidate pitch frequency one of the maxima because it is near in frequency to a previously-estimated pitch frequency of a preceding frame of the speech signal.

46. Apparatus according to claim 43, wherein the processor is adapted to determine whether the speech signal is voiced or unvoiced by comparing a value of the local maximum to a predetermined threshold.

47. Apparatus according to claim 34, wherein the processor is further adapted to encode the speech signal responsive to the estimated pitch frequency.

48. Apparatus for estimating a pitch frequency of a speech signal, comprising an audio processor, which is adapted to find a line spectrum of the speech signal, the spectrum comprising spectral lines having respective line amplitudes and line frequencies, to compute a utility function that is periodic in the frequencies of the lines in the spectrum, which function is indicative, for each candidate pitch frequency in a given pitch frequency range, of a compatibility of the spectrum with the candidate pitch frequency, and to estimate the pitch frequency of the speech signal responsive to the periodic function, wherein the utility function comprises at least one influence function that is periodic in a ratio of the frequency of one of the spectral lines to the candidate pitch frequency, and wherein the at least one influence function comprises a function of the ratio having maxima at integer values of the ratio and minima therebetween, and wherein the at least one influence function comprises a piecewise linear function c(f), having a maximum value in a first interval surrounding f=0, a minimum value in a second interval surrounding f=1/2, and a value that varies linearly in a transition interval between the first and second intervals.

49. A computer software product, comprising a computer-readable storage medium in which program instructions are stored, which instructions, when read by a computer receiving a speech signal, cause the computer to compute a first transform of the speech signal to a frequency domain over a first time interval and a second transform of the speech signal over a second time interval to the frequency domain, which contains the first time interval, and to estimate the pitch frequency of the speech signal responsive to the first and second transforms, wherein the first and second transforms comprise Short Time Fourier Transforms.

50. A product according to claim 49, wherein the instructions further cause the computer to encode the speech signal responsive to the estimated pitch frequency.

51. A computer software product, comprising a computer-readable storage medium in which program instructions are stored, which instructions, when read by a computer receiving a speech signal, cause the computer to find a line spectrum of the speech signal, the spectrum comprising spectral lines having respective line amplitudes and line frequencies, to compute a utility function, which is indicative, for each candidate pitch frequency in a given pitch frequency range, of a compatibility of the spectrum with the candidate pitch frequency, the utility function comprising at least one influence function that is periodic in a ratio of the frequency of one of the spectral lines to the candidate pitch frequency, and to estimate the pitch frequency of the speech signal responsive to the periodic function.

52. A product according to claim 51, wherein the instructions further cause the computer to encode the speech signal responsive to the estimated pitch frequency.

* * * * *